US007599645B2

(12) United States Patent
Hara et al.

(10) Patent No.: US 7,599,645 B2
(45) Date of Patent: Oct. 6, 2009

(54) DRIVE CONNECTION MECHANISM, AND IMAGE FORMING APPARATUS HAVING THE DRIVE CONNECTION MECHANISM

(75) Inventors: Kazuhiro Hara, Numazu (JP); Kenichiro Shishikura, Numazu (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 437 days.

(21) Appl. No.: 11/476,352

(22) Filed: Jun. 28, 2006

(65) Prior Publication Data

US 2007/0003321 A1 Jan. 4, 2007

(30) Foreign Application Priority Data

Jun. 30, 2005 (JP) ..... 2005-193151

(51) Int. Cl.
*G03G 15/00* (2006.01)
*G03G 15/20* (2006.01)

(52) U.S. Cl. ..... 399/167; 399/308

(58) Field of Classification Search ..... 399/167, 399/302, 308; 74/439, 440
See application file for complete search history.

(56) References Cited

U.S. PATENT DOCUMENTS 5,390,010 A * 2/1995 Yamahata et al. ..... 399/308
6,671,475 B2 * 12/2003 Katada et al. ..... 399/167 X
6,968,144 B2 * 11/2005 Mizoguchi ..... 399/167

FOREIGN PATENT DOCUMENTS

| | | |
|---|---|---|
| JP | 04-360158 | 12/1992 |
| JP | 08-087225 | 4/1996 |
| JP | 3046506 | 3/2000 |

OTHER PUBLICATIONS

Chinese Office Action dated May 9, 2008 corresponding to U.S. Appl. No. 11/476,352, filed Jun. 28, 2006.

* cited by examiner

*Primary Examiner*—Sandra L Brase
(74) *Attorney, Agent, or Firm*—Turocy & Watson, LLP

(57) ABSTRACT

A drive connection mechanism has a sliding unit which is fixed to a drive shaft extending through the photoconductive drum, a convex coupling gear which has three coupling members fixed slidably to splines formed in the periphery of the sliding unit, a compressing spring which energizes the coupling gar, and a concave coupling gear which is provided in the drum to receive and fit the convex coupling gear. When the convex coupling gear is pressed to the concave coupling gear, a force from the tapered surface to the inside acts on each coupling member. Then, the bevel gear of the convex coupling gear is stuck to the bevel gear of the concave coupling gear, the internal gears of the convex coupling gear is stuck to the splines of the drive shaft, and the centers of the drive shaft and photoconductive drum are aligned.

12 Claims, 10 Drawing Sheets

DRIVE CONNECTION MECHANISM, AND IMAGE FORMING APPARATUS HAVING THE DRIVE CONNECTION MECHANISM

CROSS-REFERENCE TO RELATED APPLICATIONS

This application is based upon and claims the benefit of priority from prior Japanese Patent Application No. 2005-193151, filed Jun. 30, 2005, the entire contents of which are incorporated herein by reference.

BACKGROUND OF THE INVENTION

1. Field of the Invention

The present invention relates to a drive connection mechanism to connect a drive unit and a driven unit. In particular, the present invention relates to a drive connection mechanism to connect a photoconductive drum of a copier or printer and its drive shaft, and an image forming apparatus having the drive connection mechanism.

2. Description of the Related Art

In a known drive connection mechanism to connect a photoconductive drum of a copier to a drive shaft provided in a main body of a copier, a coupling gear is provided rotatably together with a drive shaft and slidably along the axial direction of the drive shaft. In the periphery of the coupling gear, outer bevel gear is formed coaxially with the drive shaft. The coupling gear is energized toward the distal end of the drive shaft by a compression spring fit to the drive shaft. At the corresponding end of the photoconductive drum, internal gears like a bevel gear are formed to engage with the external gears of the coupling gear.

Therefore, when connecting the drive shaft to the photoconductive drum, fit and push the coupling gear of the drive shaft in the internal gears of the photoconductive drum, and press the external gears of the coupling gear to the internal gears of the photoconductive drum by the restoring force of the compression spring. The external gears of the coupling gear are securely engaged with the internal gears of the photoconductive drum, the driving force of the drive shaft is transmitted to the photoconductive drum, and the photoconductive drum is driven by the drive shaft.

However, in the above-mentioned drive connection mechanism, as the coupling gear is provided slidably along the drive shaft, the coupling gear can be securely engaged with the internal gears of the photoconductive drum, but a clearance exists between the coupling gear and causes a backlash. Namely, the clearance causes a backlash when the driving force is transmitted from the drive shaft to the photoconductive drum.

To eliminate a backlash of the coupling gear to the drive shaft, the inventor of this application proposes a drive connection mechanism which divides the coupling gear having the above described form into three parts in the circumferential direction (Jpn. Pat. Appln. KOKAI Publication No. 8-87225).

The drive connection mechanism has an involute spline extending in the axial direction on the periphery of a drive shaft, and has grooves to engage with the involute spline inside each coupling gear divided into three. When three coupling gears are energized in the axial direction and pressed to the internal gears of the photoconductive drum by a compression spring, each coupling gear receives repulsion toward the drive shaft from the internal gears like a bevel gear of the photoconductive drum, and each coupling gear is pressed to the drive shaft by this repulsion. Therefore, each coupling gear is securely engages with the drive shaft, and the above-mentioned backlash can be decreased.

By using the above conventional drive connection mechanism, a backlash can be decreased and a driving force can be transmitted from the drive shaft to a photoconductive drum, but the centering of the photoconductive drum and drive shaft is insufficient, the photoconductive drum swings a little during rotation, and a satisfactory image is not formed.

BRIEF SUMMARY OF THE INVENTION

It is an object of the invention to provide a drive connection mechanism which is configured to connect a drive unit to a driven unit without generating a backlash, enable accurate centering of the drive unit and driven unit, and transmit the rotation of the drive unit stably to the driven unit, and an image forming apparatus having the drive connection mechanism.

In order to achieve the above object, according to an embodiment of the invention, there is provided a drive connection mechanism comprising splines which are formed parallel to each other with equal intervals, and extended in an axial direction along the periphery of a drive shaft; a convex coupling gear which is provided with internal gears to engage with the splines, arranged rotatably together with the drive shaft through the internal gears and slidably in the axial direction of the drive shaft, provided with a first tapered surface inclined in the axial direction on an outer circumference remote from the drive shaft, the first tapered surface having a first bevel gear, and divided into several parts in the circumferential direction; an energizing member which energizes the convex coupling gear divided into several parts in the axial direction to converge the first tapered surface; and a concave coupling gear which is provided in the driven unit connected to the drive shaft, and a concave part having a second tapered surface opposite to the first tapered surface of each of the convex coupling gear divided into several parts, and has a second bevel gear to engage with the first bevel gear on the second tapered surface, wherein the first bevel gear of the convex coupling gear is stuck without a clearance to the second bevel gear of the concave coupling gear, the splines of the drive shaft are stuck without a clearance to the internal gears of the convex coupling gear, and the centers of the drive shaft and driven unit are automatically aligned, in the state that the convex coupling gear is pressed to the concave coupling gear by the force of the energizing member, and the drive shaft is connected to the driven unit.

According to another embodiment of the invention, there is provided a drive connection mechanism comprising a substantially cylindrical sliding unit which is securely provided at the proximal end of a drive shaft extending through a driven unit with the distal end held rotatably, and has splines extended in an axial direction and formed parallel to each other with equal intervals in the outer circumference; a convex coupling gear which is provided with internal gears to engage with the splines of the sliding part, arranged rotatably together with the drive shaft through the internal gears and slidably in the axial direction of the drive shaft, provided with a first tapered surface inclined in the axial direction to converge toward the distal end on an outer circumference remote from the drive shaft, the first tapered surface having a first bevel gear, and divided into several parts in the circumferential direction; an energizing member which energizes the convex coupling gear divided into several parts in the axial direction toward the driven unit; and a concave coupling gear which is provided in the driven unit, and has a concave part having a second tapered surface opposite to the first tapered surface of each of the convex coupling gear divided into several parts, and a second bevel gear to engage with the first bevel gear on the second tapered surface.

According to still another embodiment of the invention, there is provided an image forming apparatus comprising a substantially cylindrical image holding unit; a drive unit for rotating the image holding unit; an image forming means for forming an image in the periphery of the image holding unit rotated by the drive unit; a transfer means for transferring the image formed on the periphery of the image holding unit by the image forming means to a transfer medium; and a drive connection mechanism which coaxially connects the drive shaft to transfer the driving force of the drive unit to the image holding unit, wherein the drive connection mechanism has splines which are formed parallel to each other with equal intervals, and extended in an axial direction along the periphery of the drive shaft; a convex coupling gear which is provided with internal gears to engage with the splines, arranged rotatably together with the drive shaft through the internal gears and slidably in the axial direction of the drive shaft, provided with a first tapered surface inclined in the axial direction to converge toward the image holding unit on an outer circumference remote from the drive shaft, the first tapered surface having a first bevel gear, and divided into several parts in the circumferential direction; an energizing member which energizes the convex coupling gear divided into several parts in the axial direction toward the image holding unit; a concave coupling gear which is provided in the image holding unit, and has a concave part having a second tapered surface opposite to the first tapered surface of each of the convex coupling gear divided into several parts, and a second bevel gear to engage with the first bevel gear on the second tapered surface; and the first bevel gear of the convex coupling gear is stuck without a clearance to the second bevel gear of the concave coupling gear, the splines of the drive shaft are stuck without a clearance to the internal gears of the convex coupling gear, and the centers of the drive shaft and image holding unit are automatically aligned, in the state that the convex coupling gear is pressed to the concave coupling gear by the force of the energizing member, and the drive shaft is connected to the image holding unit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will be explained in detail hereinafter with reference to the accompanying drawings.

Figure 1:
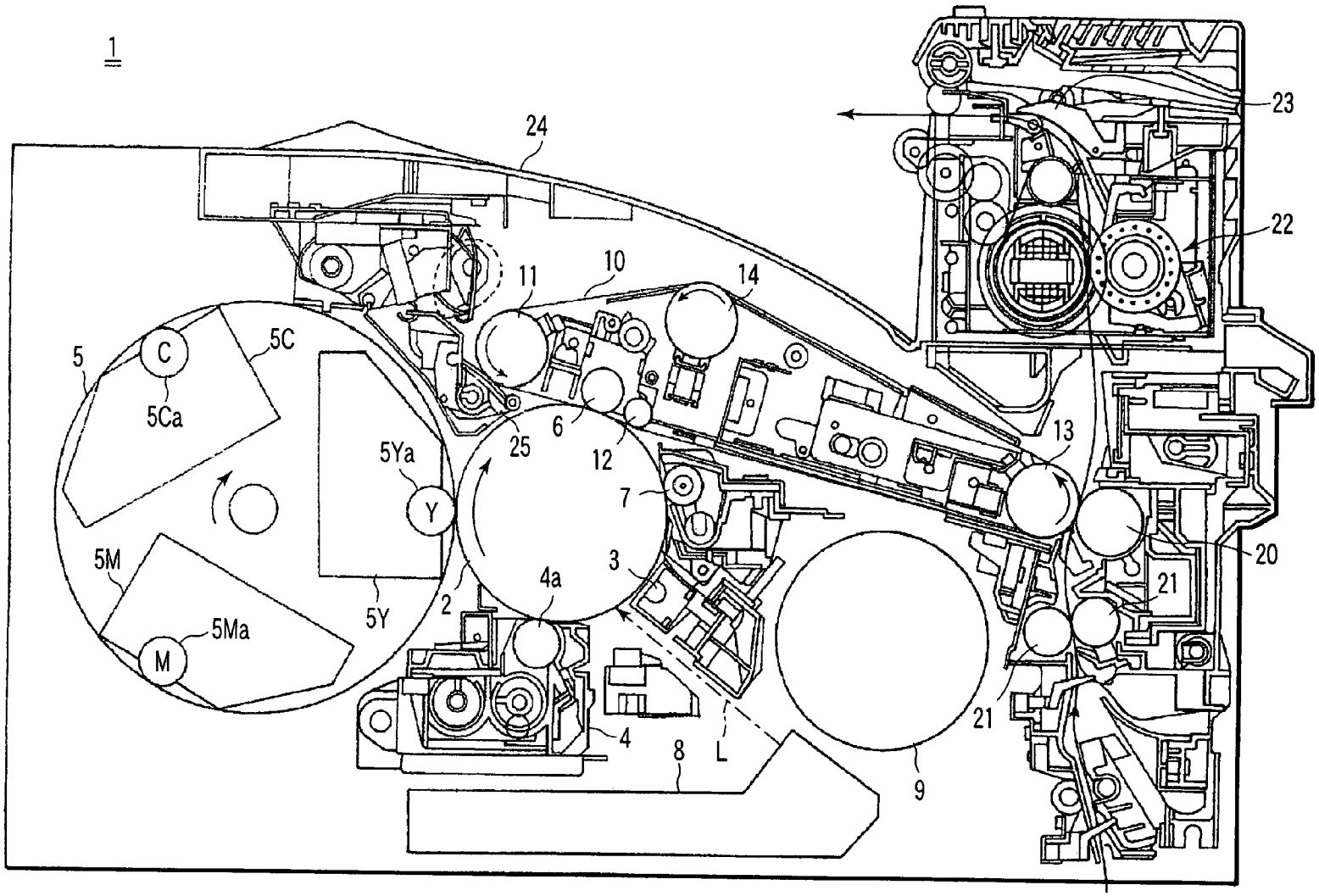
FIG. 1 is a schematic diagram showing a printer according to an embodiment of the invention.
Figure 2:
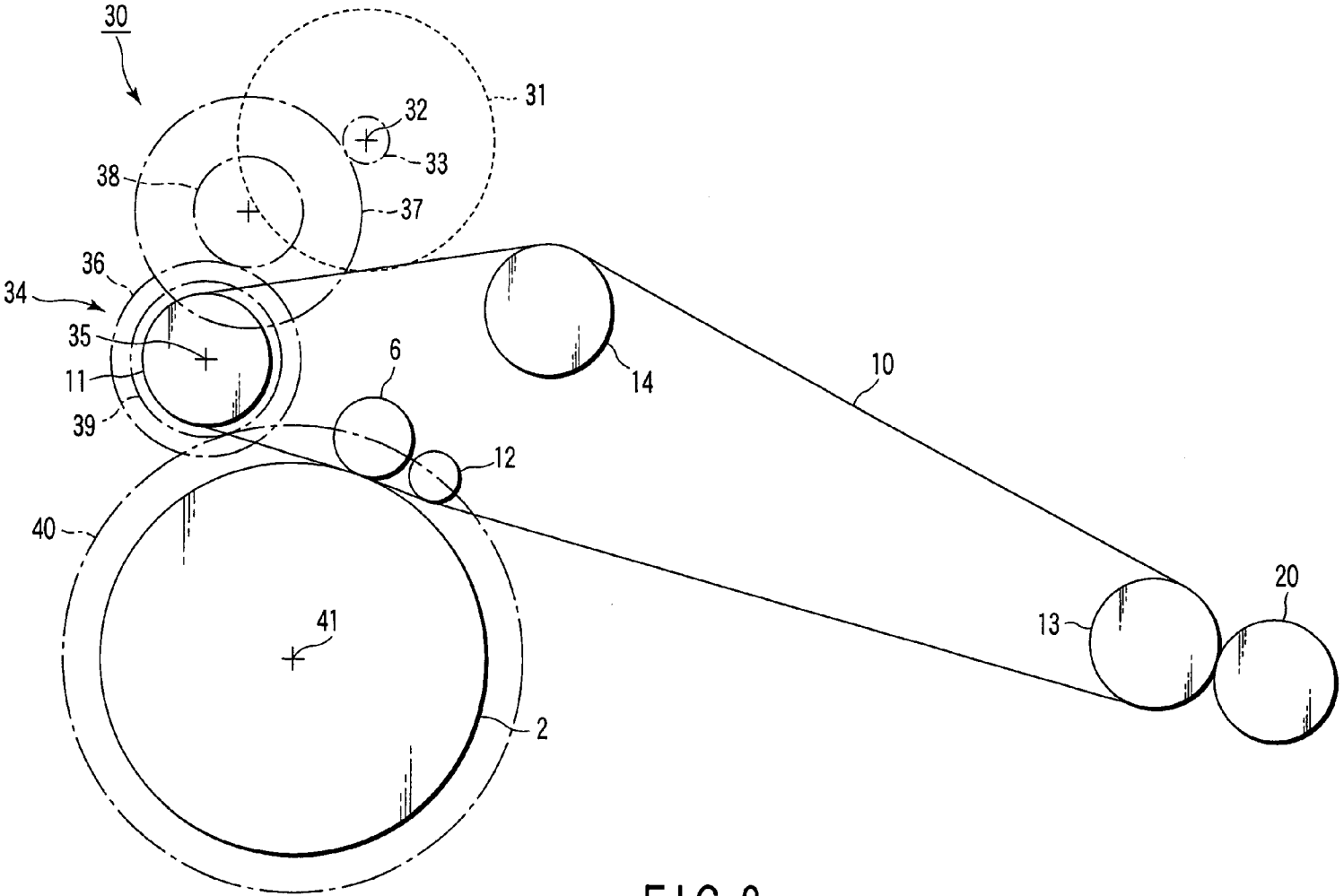
FIG. 2 is a diagrammatic sketch showing a drive transmission system of a rotary drive unit incorporated in the printer of FIG. 1.
Figure 3:
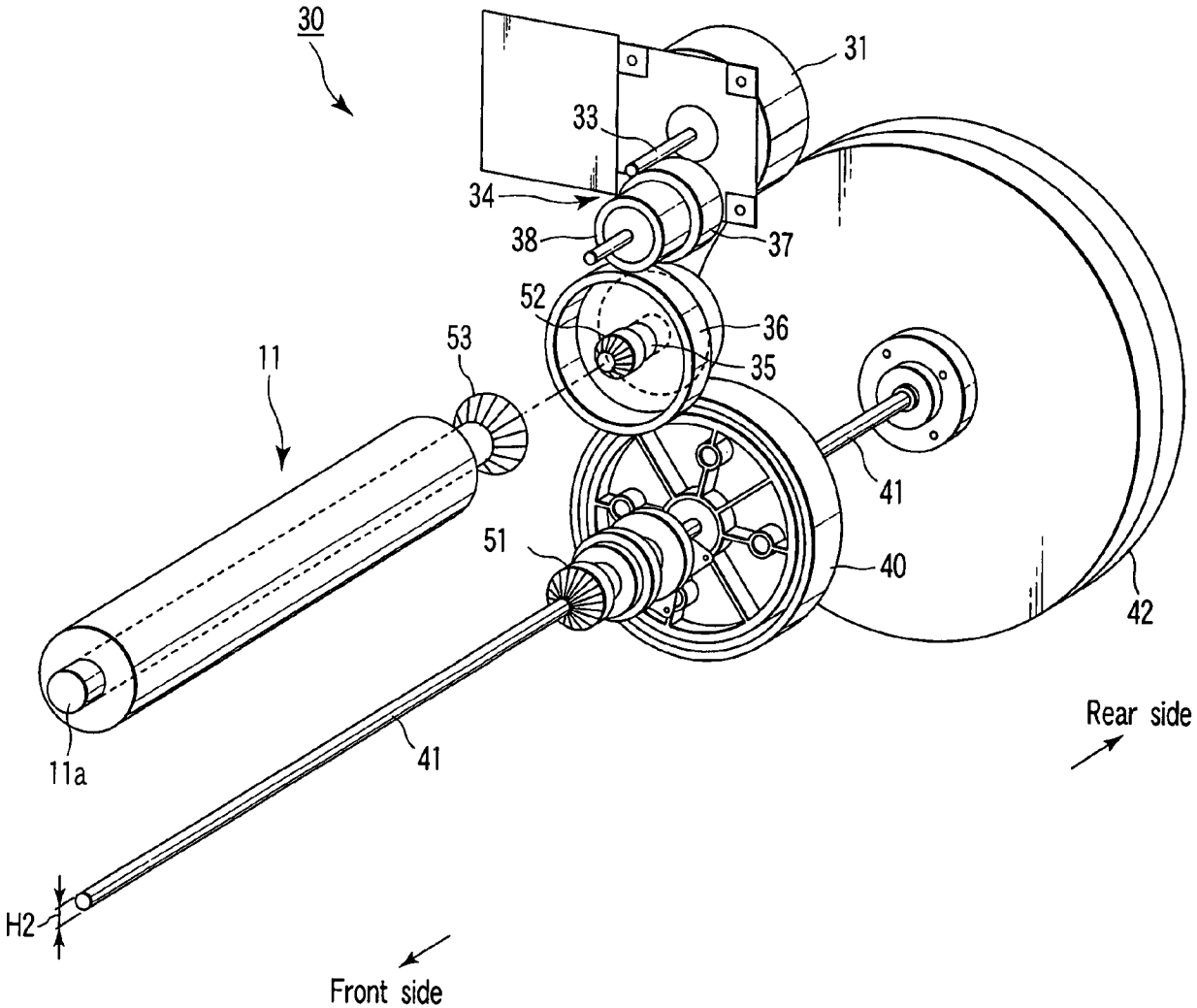
FIG. 3 is a schematic perspective view showing the rotary drive unit of FIG. 2.

FIG. 1 is a schematic diagram of an internal structure of MFP (Multi-Functional Printer) 1 of an intermediate transfer system as an image forming apparatus according to an embodiment of the invention. FIG. 2 is a diagrammatic sketch showing a drive transmission system of a rotary drive unit described later incorporated in the MFP 1 of FIG. 1. FIG. 3 is a schematic perspective view showing the rotary drive unit of FIG. 2. In the description, the invention is applied to the MFP 1, but the invention may be applied to other image forming apparatus, such as an electrophotographic digital copier.

As shown in FIG. 1, in the main body of MFP 1, a photoconductive drum 2 as an image holding unit is provided rotatably in the clockwise direction. Around the photoconductive drum 2, a charging unit 3, a black color developing unit 4, a rotary color developing unit 5, a primary transfer roller 6, and a cleaning unit 7 are sequentially provided along the rotating direction of the drum.

The charging unit 3 charges the surface of the photoconductive drum 2. A laser beam L emitted from a laser unit 8 is radiated to the surface of the photoconductive drum 2 through a clearance between the charging unit 3 and black color developing unit 4. By the radiation of laser beam L, the charged surface of the photoconductive drum 2 is exposed, and an electrostatic latent image is formed on the surface of the photoconductive drum 2.

The black color developing unit 4 supplies black (K) toner to the surface of the photoconductive drum 2 through a mug roller 4*a*. By the supply of black toner, the electrostatic latent image on the photoconductive drum 2 is developed to a black visible image. A large-capacity black toner bottle 9 is prepared to supply the black toner to the black color developing unit 4.

The color developing unit 5 has a yellow color developing part 5Y, a magenta color developing part 5M and a cyan color developing part 5C, and is rotated clockwise at the position adjacent to the photoconductive drum 2 in the drawing. The yellow color developing part 5Y has a mug roller 5Y*a* separable from the surface of the photoconductive drum 2, and supplies yellow (Y) toner to the surface of the photoconductive drum 2, when the mug roller 5Y*a* comes in contact with the surface of the photoconductive drum 2. The magenta color developing part 5M has a mug roller 5M*a* separable from the surface of the photoconductive drum 2, and supplies magenta (M) toner to the surface of the photoconductive drum 2, when the mug roller 5M*a* comes in contact with the surface of the photoconductive drum 2. The cyan color developing part 5C has a mug roller 5C*a* separable from the surface of the photoconductive drum 2, and supplies cyan (C) toner to the surface of the photoconductive drum 2, when the mug roller 5C*a* comes in contact with the surface of the photoconductive drum 2.

The photoconductive drum 2 is rotated by one to several turns according to the number of electrostatic latent images formed on the periphery per 1 image. Whenever the photoconductive drum 2 is rotated, the toner of each color is supplied from the black developing unit 4 or color developing unit 5, and the electrostatic latent image on the periphery is developed to the supplied toner color.

The primary transfer roller 6 is provided inside the endless conveying belt 10 (intermediate transfer unit) contacting the photoconductive drum 2 while moving, and at the position facing to the photoconductive drum 2 through the belt. The primary transfer roller 6 supplies appropriate electric charge to the rear side of the conveying belt 10 running in the counterclockwise direction in the drawing, and transfers a visible image of each color toner formed on the periphery of the photoconductive drum 2 to the surface of the conveying belt 10.

The cleaning unit 7 cleans the surface of the photoconductive drum 2 after the visible image is transferred. The toner remained on the surface of the photoconductive drum 2 is removed by this cleaning.

The conveying belt 10 is wound and stretched around a drive roller 11 (rotary unit), a wind roller 12, a driven roller 13 and a tension roller 14, and moved in the counterclockwise direction in the drawing by rotating the drive roller 11 in the direction of the arrow in the drawing. The wind roller 12 acts to press the conveying belt 10 to the photoconductive drum 2. The tension roller 14 is provided to adjust the tension of the conveying belt 10.

A secondary roller 20 is provided at the position on the right of the conveying belt 10 and contacting the driven roller 13 through the belt in the drawing. Therefore, a paper sheet (transferred medium) supplied from a not-shown paper supply cassette to a nip between registration rollers 21 is fed to between the conveying belt 10 and secondary transfer roller 20 by the registration rollers 21. In this time, the visible image on the conveying belt 10 is transferred to the paper sheet by the secondary transfer roller 20. After the visible image is transferred, the paper sheet is fed to a fixing unit 22. The fixing unit 22 heats and fuses the visible image transferred to the paper sheet, and fixes the image to the paper sheet. The paper sheet passed through the fixing unit 22 is ejected to an ejected paper tray 24 at the top of the MFP 1 through a guide gate 23.

The secondary transfer roller 20 is provided separable from the conveying belt 10, to come in contact with the conveying belt 10 only when the transfer is necessary, and separate from the conveying belt 10 when the transfer is unnecessary.

A cleaning unit 25 is provided at the left end of the conveying belt 10 and close to the drive roller 11 through the belt 10 in the drawing. The cleaning unit 25 is provided separable from the conveying belt 10 wound around the drive roller 11, and cleans the conveying belt 10 when it comes in contact with the belt.

The photosensitive drum 2 and conveying belt 10 are driven by a rotary drive unit 30 shown in FIG. 2 and FIG. 3.

As shown in FIG. 2 and FIG. 3, the rotary drive unit 30 is provided close to the rear side of the MFP 1, and has a common drive motor 31 as a driving source of the photoconductive drum 2 and intermediate conveying belt 10. The drive motor 31 is a servomotor with minimum vibration, a stepping motor with micro steps or a DC brush-less motor.

A motor drive gear 33 is provided integrally with an output shaft 32 of the drive motor 31. The motor drive gear 33 engages with a belt driven gear 36 provided in a belt driving shaft 35 (drive shaft) for rotating the drive roller 11, through a reduction gear mechanism 34 composing a multistage reduction gear train.

The multistage reduction gear mechanism 34 composes a first-stage reduction gear train by a first reduction gear 37 engaging with the motor drive gear 33. A second stage intermediate reduction gear train is composed of a second reduction gear 38 provided coaxially with the first reduction gear 37 and the belt driven gear 36 engaging with the second reduction gear 38.

A final stage third reduction gear 39 is provided coaxially with the belt driven gear 36 of the intermediate reduction gear train. The third reduction gear 39 directly engages with a final stage fourth reduction gear 40. The final stage reduction gear train is composed as a reduction gear train for driving the photoconductive drum 2.

Namely, the belt driven gear 36 engages with the fourth reduction gear 40 through the third reduction gear 39, and the fourth reduction gear 40 is pivoted on a drum driving shaft 41 (drive shaft). A flywheel 42 is attached pivotally to the drum driving shaft 41 of the photoconductive drum 2, and the photoconductive drum 2 can be rotated stably and smoothly without generating an uneven rotation by the inertial force of the flywheel 42. In FIG. 2, each gear of the multistage reduction gear train composing the reduction gear mechanism 34 is expressed by a pitch circle indicated by a chain line.

Figure 4:
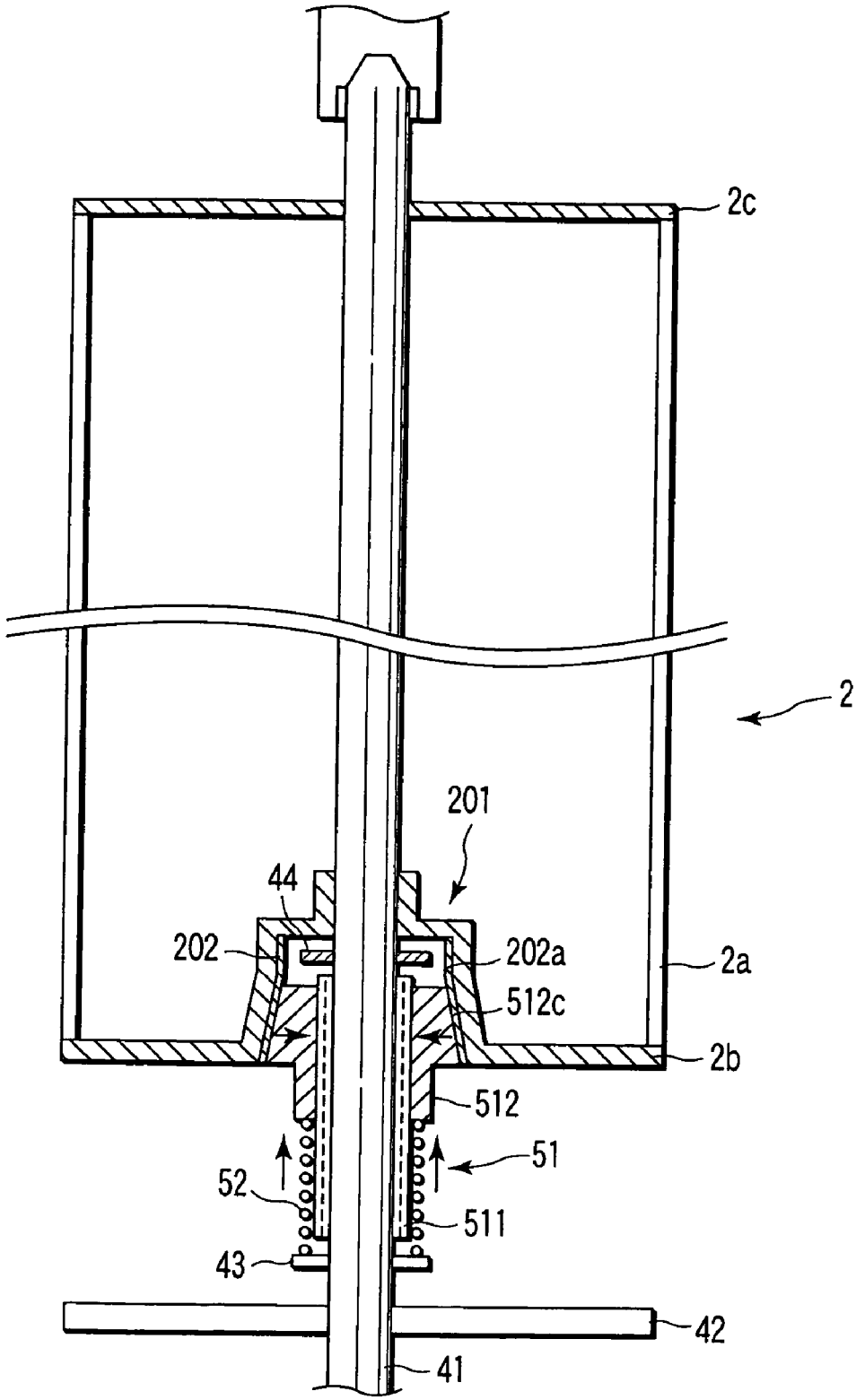
FIG. 4 is a schematic sectional view showing a drive connection mechanism according to an embodiment of the invention.
Figure 5:
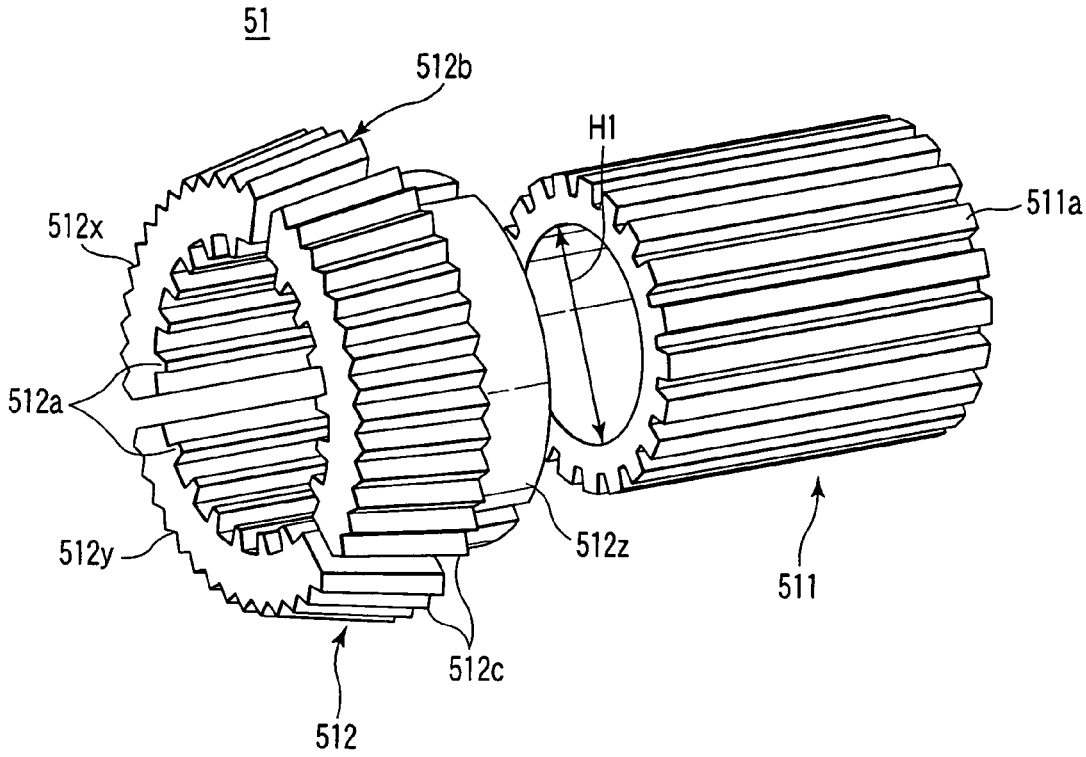
FIG. 5 is an exploded perspective view showing the outline structure of a convex connection member of the drive connection mechanism of FIG. 4.
Figure 6:
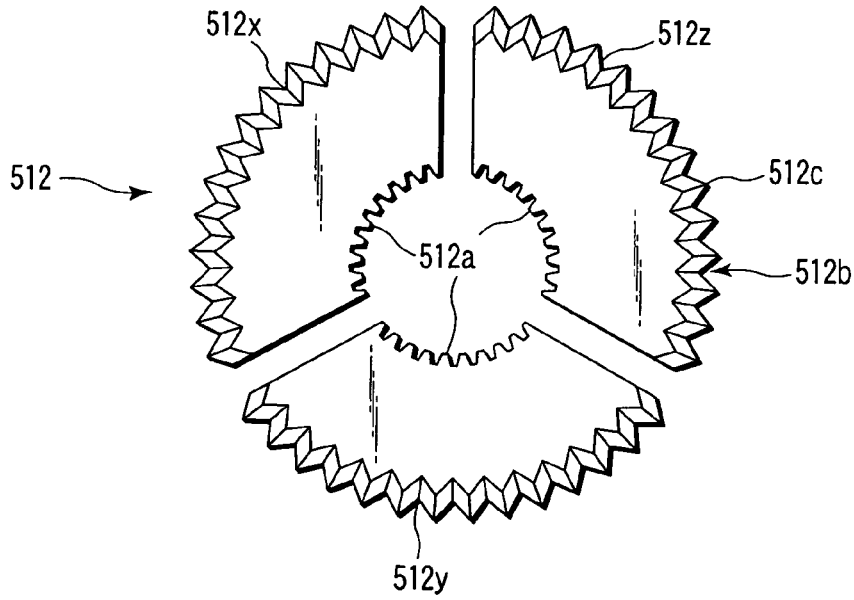
FIG. 6 is a schematic diagram of a convex coupling gear of FIG. 5, viewed from the axial direction.

Hereinafter, an explanation will be given on a drive connection mechanism according to an embodiment of the invention, which connects the drum driving shaft 41 and photoconductive drum 2. FIG. 4 is a sectional view of the drive connection mechanism connected with the photoconductive drum 2 and drum driving shaft 41. FIG. 5 is a perspective view of a convex connection member for connecting the photoconductive drum 2 and drum driving shaft 41. FIG. 6 shows three coupling members of the convex connection member viewed from the axial direction.

In this embodiment, the drum driving shaft 41 extends long and narrow from the rear side of MFP 1 to the front side, and penetrates through the center of the photoconductive drum 2. The inserting end of the drum driving shaft 41, or the front side end of the apparatus is held rotatably in the cabinet of MFP 1.

As shown in FIG. 4 and FIG. 5, the proximal end of the drum driving shaft 41 is provided with a convex connection member 51 of the drive connection mechanism for transmitting the rotary driving force of the drum driving shaft 41 to the photoconductive drum 2. In other words, the convex connection member 51 is provided at the position acting at the rear side end of the photoconductive drum 2 after the drum driving shaft 41 is inserted into the photoconductive drum 2. The convex connection member 51 includes a substantially cylindrical sliding unit 511, and a convex coupling gear 512 fit slidably to the outside of the sliding unit 511.

The sliding unit 511 is provided integrally with external gears 511*a* (splines) extending in the axial direction, on the peripheral surface. The external gears 511*a* are arranged parallel with equal intervals in the circumferential direction over the full length of the sliding unit 511. The internal circumference diameter H1 (refer to FIG. 5) of the sliding unit 511 is slightly smaller than the outside diameter H2 (refer to FIG. 3) of the drum driving shaft 41. The drum driving shaft 41 is pressed into the sliding unit 511 to fix them. Any method may be used to fix the sliding unit 511 to the drum driving shaft 41. For example, an adhesive may be used to fix them.

The convex coupling gear 512 is divided into several parts in the circumferential direction. In this embodiment, the convex coupling gear 512 is divided into three same shape parts, 512*x*, 512*y* and 512*z* as shown in FIG. 6. However, the number of dividing the convex coupling gear 512 is not limited to three, but may be optionally set.

Among the three same shaped coupling members, the coupling member 512*x* has internal gears 512*a* in the internal circumference (the surface opposite to the sliding unit 511), which are engaged with external gears 511*a* provided in the outer circumference of the sliding unit 511. The internal gears 512*a* extend in the same direction as the external gears 511*a* of the sliding unit 511, and have substantially the same shape as the external gears 511*a*. Namely, the coupling member 512*x* is rotatable as one body with the sliding unit 511 and slidable in the axial direction with respect to the sliding unit 511, in the state that the internal gears 512*a* are engaged with the external gears 511*a*.

The coupling member 512*x* has a virtual tapered surface 512*b* on the opposite side of the internal gears 512*a*, or in the outer circumference remote from the drum driving shaft 41. The virtual tapered surface 512*b* is slightly inclined in the direction to converge toward the distal end of the drum driving shaft 41. The virtual tapered surface 512*b* has a bevel gear 512*c* (first bevel gear) consisting of gears with triangular cross sections arranged with equal intervals. Namely the bevel gear 512*c* is slightly inclined in the direction to converge toward the distal end of the drum driving shaft 41.

Three coupling members 512*a*, 512*y* and 512*z* have a certain clearance in the circumferential direction, in the state that they are stuck to the sliding unit 511 as shown in FIG. 4. Concretely, as described later in detail, comparing with a non-divided coupling gear 612 shown in FIG. 11 (actually, a non-divided gear is not used), the convex coupling gear 512 of this embodiment divided into three parts lacks one bevel gear (total 3 gears) in the clearance between the divided three parts.

More concretely, as shown in FIG. 6, each of the three coupling members 512*x*, 512*y* and 512*z* has the same number of internal gear 512*a* in the inner circumference, and the same number of bevel gear 512*c* in the outside tapered surface 512*b*. In this embodiment, each of the coupling members 512*x*, 512*y* and 512*z* has ten internal gears 512*a* and fourteen bevel gears 512*c*.

When making the coupling members 512*x*, 512*y* and 512*z* out of metal, they can be formed by sintering by using the same mold. When using resin for forming the coupling members 512*x*, 512*y* and 512*z*, a common mold for injection molding can be used. The manufacturing cost can be decreased by making the divided coupling members in the same shape, and by using a common mold.

Back to FIG. 4, an e-ring 44 is fit to the drum driving shaft 41 as a stopper to control movement of the convex coupling gear 512 in the axial direction. The e-ring 44 controls the movement of the coupling member in the axial direction by contacting the end portions remote from the flywheel 42 of the three coupling members 512*x*, 512*y* and 512*z* pressed by a compression spring 52 (en energizing member) described later toward the end of the axial direction.

The photoconductive drum 2 functioning as a driven unit of the invention includes a cylindrical photosensitive member 2*a* made by forming photosensitive material on an aluminum roller surface, and flanges 2*b* and 2*c* which are provided at both ends of the photosensitive member 2*a* and hold the photosensitive member 2*a* substantially in a cylindrical form. At the central portion of one flange 2*b* positioned at the proximal end of the drum driving shaft 41, a concave part which engages with the convex coupling gear 512 provided in the drum driving shaft 41, that is, a concave coupling gear 201 is provided. The concave coupling gear 201 forms a drive connection mechanism, incorporating with the sliding unit 511 and convex coupling gear 512.

The concave coupling gear 201 has a virtual tapered surface 202 opposite to the virtual tapered surface 512*b* of the convex coupling gear 512. The tapered surface 202 has a bevel gear 202*a* to engage with the bevel gear 512*c* of the convex coupling gear 512. In this embodiment, the bevel gear 202*a* has substantially the same shape as the bevel gear 512*c* of the convex coupling gear 512, and the two bevel gears are stuck to each other when arranged in the state shown in FIG. 4.

An e-ring 43 is fit to the drum driving shaft 41 as a stopper to lock the proximal end of the compression spring 52. In other words, the e-ring 43 is provided between the sliding unit 511 and flywheel 42, and the compression spring 52 is provided between the e-ring 43 and convex coupling gear 512. Therefore, the proximal end of the compression spring 52 is controlled by the e-ring 43, and the compression spring 52 functions to press the convex coupling gear 512 to the concave coupling gear 201 of the photoconductive drum 2.

Therefore, as shown in FIG. 4, by penetrating the drum driving shaft 41 through the center of the photoconductive drum 2, holding the distal end of the shaft rotatably in the cabinet of MFP 1, and fitting the convex coupling gear 512 of the drum driving shaft 41 into the concave coupling gear 202 provided in the flange 2*b* of the photoconductive drum 2, three coupling members 512*x*, 512*y* and 512*z* provided slidably to the sliding unit 511 are pressed by the compression spring 52 upward (front side) in the drawing toward the concave coupling gear 201. In this time, a force directing inward the drum driving shaft 41 from the tapered surface 202 of the concave coupling gear (in the direction of the arrow in the drawing) acts on each of the divided coupling members 512*x*, 512*y* and 512*z*, and the coupling members 512*x*, 512*y* and 512*z* are pressed inward toward the sliding unit 511.

The bevel gears 512*c* of the three coupling members 512*x*, 512*y* and 512*z* are stuck to and engaged with the bevel gear 202*a* of the concave coupling gear 201, and the internal gears 512*a* of the coupling members 512*x*, 512*y* and 512*z* are stuck to and engaged with the external gears 511*a* of the sliding unit 511.

Therefore, the driving force from the drum driving shaft 41 can be surely and stably transmitted to the photoconductive drum 2 through the convex connection member 51 and concave coupling gear 201 (i.e., the drive connection mechanism). Namely, by adopting the drive connection mechanism of this embodiment, a backlash is eliminated almost completely, a vibration of the photoconductive drum 2 during rotation of the drum is decreased, and a jitter in a copy image is prevented.

Particularly, according to the drive connection mechanism of this embodiment, the bevel gear 202*a* of the concave coupling gear 201 has substantially the same shape as the bevel gear 512*c* of the convex coupling gear 512, and the internal gears 512*a* of the convex coupling gear 512 have substantially the same shape as the external gears 511*a* of the sliding unit 511. Therefore, the centers of the drum driving shaft 41 and photoconductive drum 2 can be automatically aligned, by sticking the coupling members 512*x*, 512*y* and 512*z* to the concave coupling gear 201 and sliding unit 511 as described above.

Use of the drive connection mechanism of this embodiment prevents a troublesome vibration of the photoconductive drum 2 caused by deviation of the center of the drum driving shaft 41 from the center of the photoconductive drum 2 during rotation of the drum, and forms a good image.

As described above, the sliding unit 511 is securely fixed to the drum driving shaft 41 by press-fitting, and the power from the drum driving shaft 41 can be surely transmitted to the photoconductive drum 2. Particularly, the sliding unit 511 is formed to the necessary length by using the material different from the drum driving shaft 41, and the spline 511*a* can be easily machined, and the apparatus can be configured at a low price.

Contrarily, when providing spline 511*a* for sliding the coupling members 512*x*, 512*y* and 512*z* with respect to the drum driving shaft 41 by carving directly in the drum driving shaft 41, it is necessary to form the spline 511*a* over the full length of the drum driving shaft 41. This is difficult, and increases the manufacturing cost. To decrease the cost, it is considerable to use a mold for forming the drum driving shaft 41 having the spline 511*a* over the full length. However, in this case, engagement with the coupling members 512*x*, 512*y* and 512*z* may become worse.

Therefore, according to this embodiment, prepare the sliding unit 511 capable of slidably mounting the coupling members 512*x*, 512*y* and 512*z* as a member different from the drum driving shaft 41, and fix it securely to the drum driving shaft 41 by press-fitting. The manufacturing labor and cost can be decreased thus, and the driving force of the motor can be stably and securely transmitted to the photoconductive drum 2.

The drum driving shaft 41 is fixed to the sliding unit by press-fitting, but other common fixing methods such as bonding, welding and screw-fitting may be used.

Figure 7:
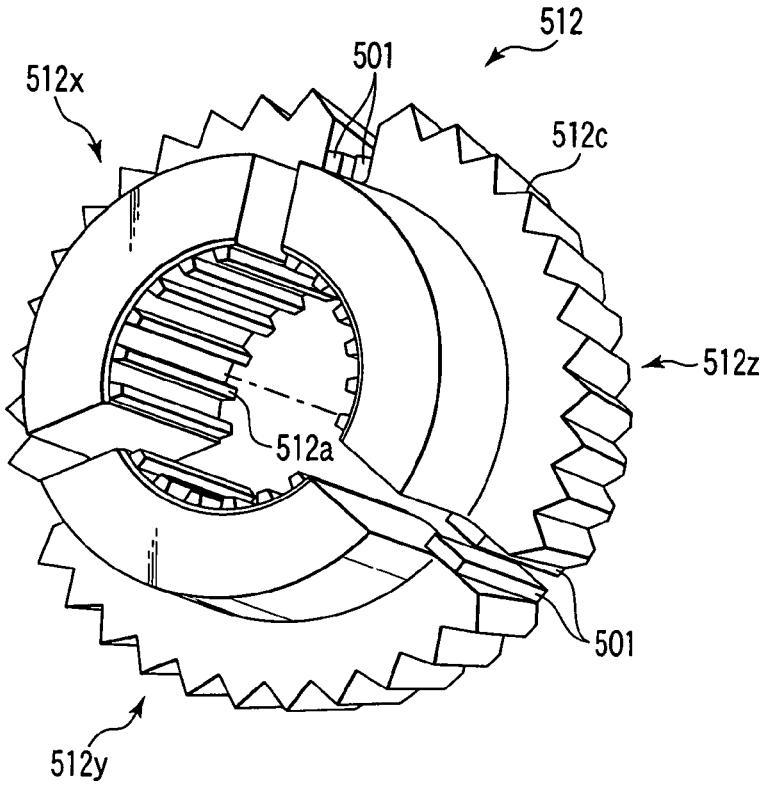
FIG. 7 is a schematic perspective view for explaining a swing prevention structure of the convex coupling gear.
Figure 8:
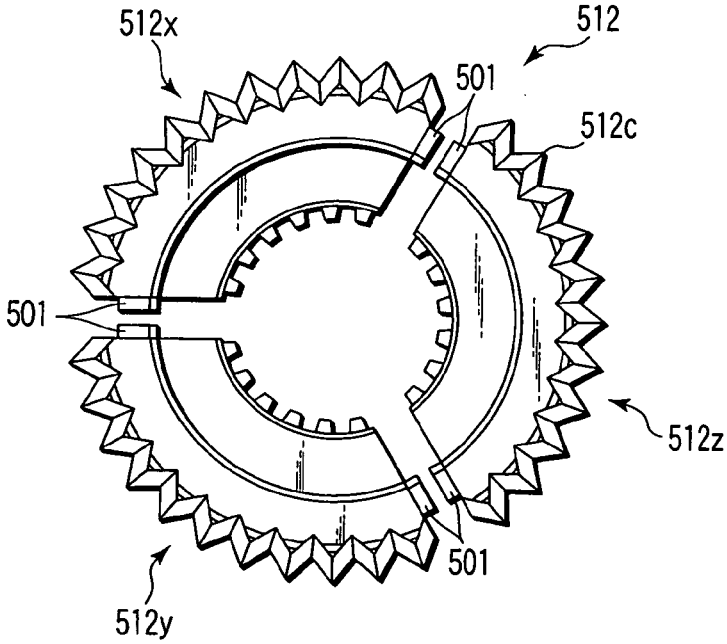
FIG. 8 is a schematic view of the convex coupling gear of FIG. 7, viewed from the axial direction.

Next, an explanation will be given on a structure to prevent swinging of the convex coupling gear 512 with reference to FIG. 7 and FIG. 8. FIG. 7 is a perspective view of the convex coupling gear 512 provided with a swing prevention structure. FIG. 8 shows the convex coupling gear 512 viewed from the axial direction.

The convex coupling gear 512 has projections 501 at the end-faces of the divided coupling members 512*x*, 512*y* and 512*z* opposite to each other. The projections 501 are provided at the position to permit interference with each other at the opposite end-faces of the divided coupling members 512*x*, 512*y* and 512*z*. The height of the projections 501 is set to the level that the coupling members 512*x*, 512*y* and 512*z* do not come in contact with each other in the normal state stuck closely to the sliding unit 511.

The projections 501 control the coupling members 512*x*, 512*y* and 512*z* moving in the circumferential direction when the photoconductive drum 2 is coupled to the drum driving shaft 41. More precisely, once the projections 501 contact at their distal ends as the coupling members 512*x*, 512*y* and 512*z* move in the circumferential direction, the coupling members 512*x*, 512*y* and 512*z* can no longer move at all.

Even if the coupling members 512*x*, 512*y* and 512*z* swing while the photoconductive drum 2 is being coupled to the drum-driving shaft 41, the swing can be minimized. The coupling members 512*x*, 512*y* and 512*z* can therefore easily mesh with the concave coupling gear 201.

Suppose the coupling members 512*x*, 512*y* and 512*z* have no projections 501. Then, they are much spaced from one another and can move for a relatively long distant in the circumferential direction. They inevitably swing in the circumferential direction. If the swing increases to some extend, the coupling members can hardly mesh with the concave coupling gear 201. This is why the projections 501 should be provided on the opposing ends of the coupling members 512*x*, 512*y* and 512*z*.

Figure 9:
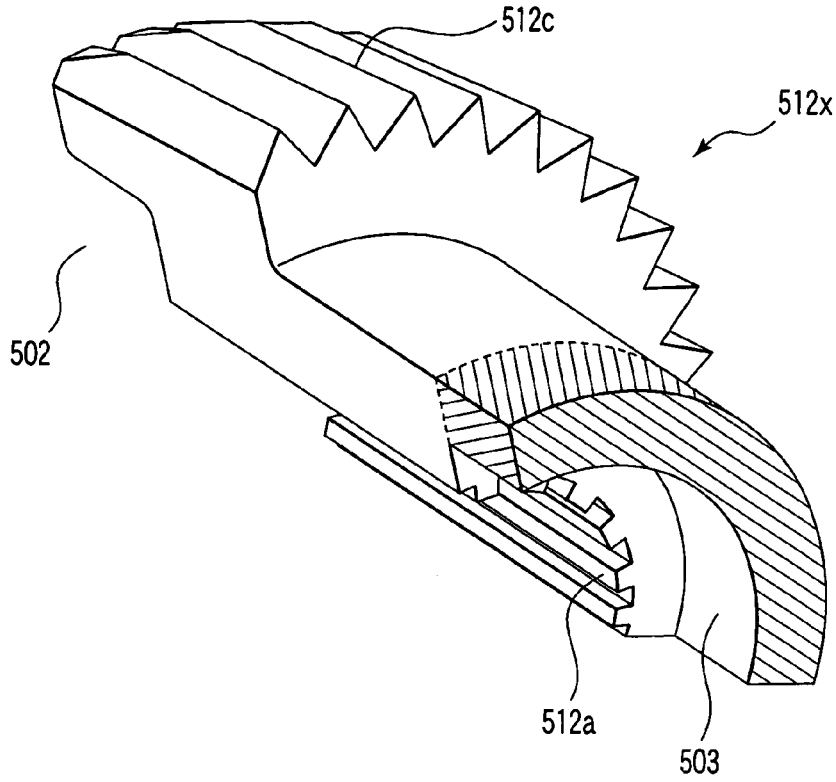
FIG. 9 is a schematic perspective view for explaining a further characteristic structure of the convex coupling gear.
Figure 10:
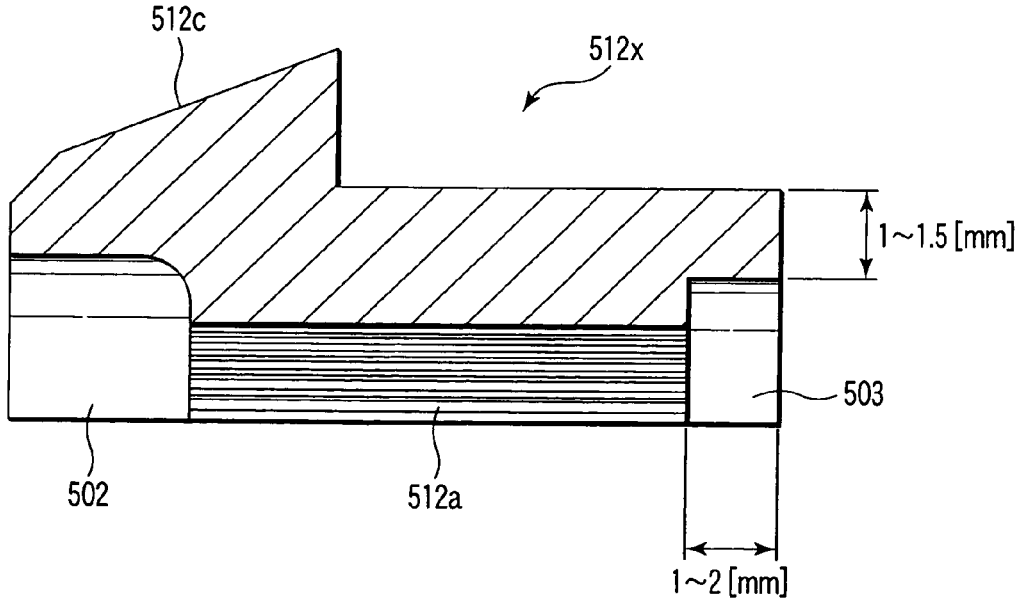
FIG. 10 is a sectional view of the coupling member of FIG. 9.

Next, an explanation will be given on another characteristic structure of the coupling members 512*x*, 512*y* and 512*z* of this embodiment with reference to FIG. 9 and FIG. 10. FIG. 9 is a perspective view of one representative coupling member 512*x*. FIG. 10 is a sectional view of the coupling member along the axial direction. The other coupling members 512*y* and 512*z* have the same characteristic structure.

The coupling member 512*x* according to this embodiment has two large-diameter portions 502 and 503 (staged portion) having no internal gears 512*a* at both ends in the axial direction. These large-diameter portions 502 and 503 do not interfere with the spline 511*a* of the sliding unit 511, and act as follows.

When two e-rings 43 and 44 explained in FIG. 4 are fit to the drum driving shaft 41, the e-rings may contact and damage the part near the end portion in the axial direction of the sliding unit 511. In this case, a burr may be generated in the spline 511*a* formed in the periphery of the sliding unit 511, affecting the slidability with respect to the coupling members 512*x*, 512*y* and 512*z*. Namely, the internal gears 512*a* of the coupling members 512*x*, 512*y* and 512*z* are easily get caught by the spline 511*a* in the part close to the end portion in the axial direction of the sliding unit 511.

Therefore, in this embodiment, large-diameter portions 502 and 503 are formed at both ends of the coupling members 512*x*, 512*y* and 512*z*, so that the internal gears of the coupling members 512*x*, 512*y* and 512*z* do not contact the part close to both ends of the axial direction where there is a high possibility of damaging the spline 511. This prevents deterioration of the slidability in all movable ranges of the coupling members 512*x*, 512*y* and 512*z*.

Figure 11:
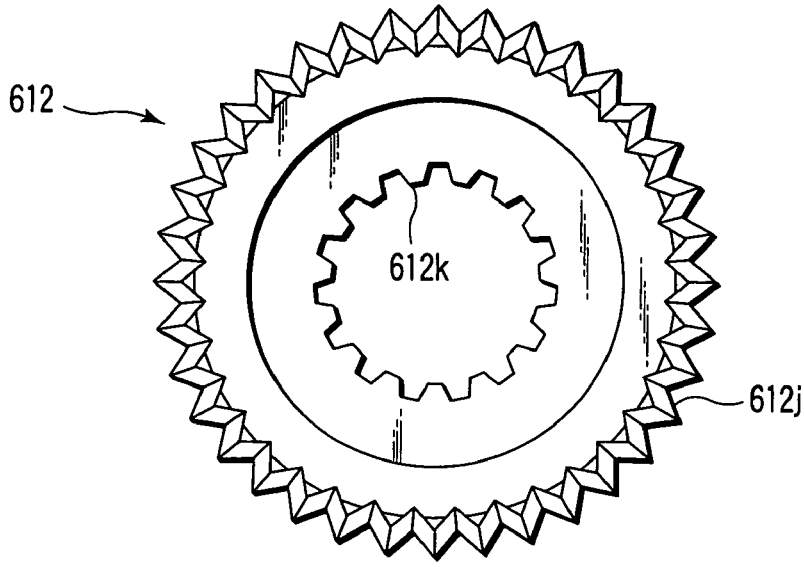
FIG. 11 is a schematic view of a virtual convex coupling gear viewed from the axial direction.
Figure 12:
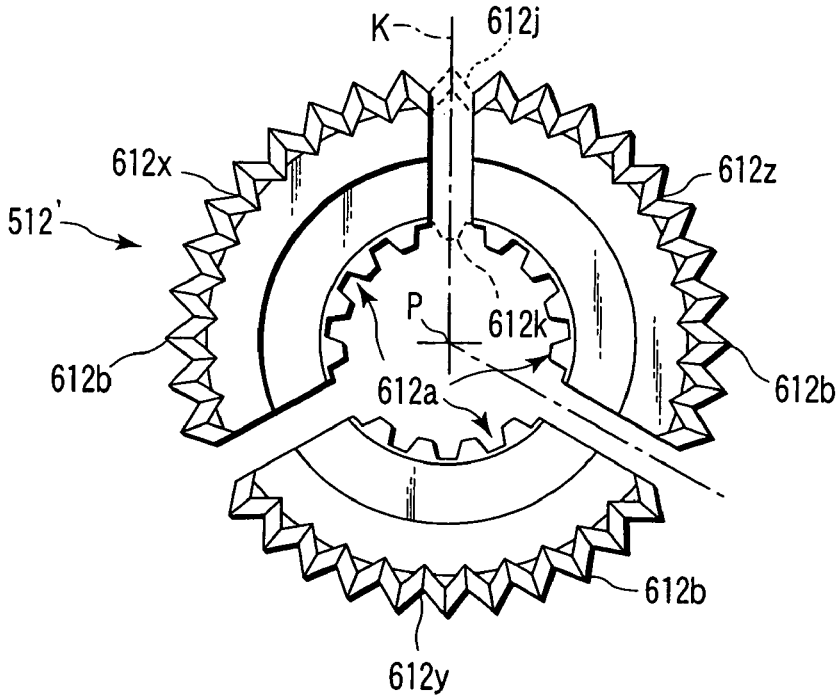
FIG. 12 is a schematic diagram of a convex coupling gear according to a first modification, viewed from the axial direction.
Figure 13:
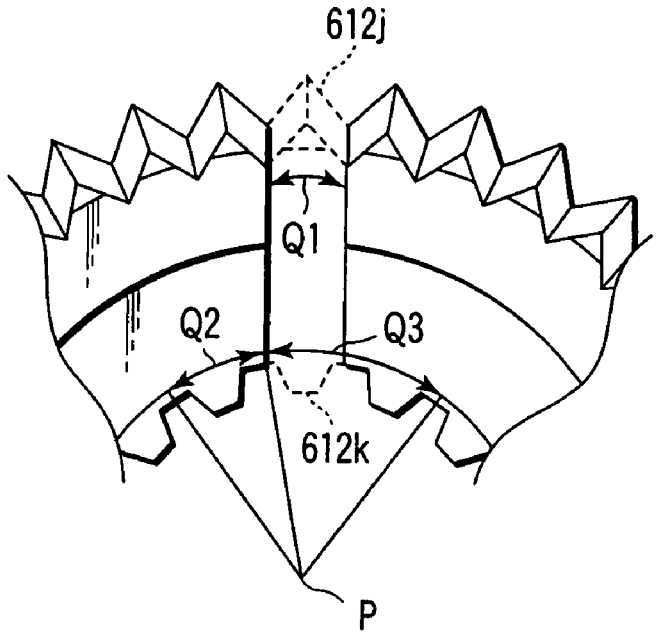
FIG. 13 is a partially magnified view of the essential part of the convex coupling gear of FIG. 12.

Next, a first modification of the convex coupling gear 512 will be explained with reference to FIG. 11 to FIG. 13. FIG. 11 shows a virtual coupling gear 612 not divided in the circumferential direction, viewed from the axial direction. FIG. 12 shows a coupling gear 512' according to a first modification, viewed from the axial direction. FIG. 13 is a partially magnified view of the characteristic part of the coupling gear 512' of FIG. 12.

Unlike the convex coupling gear 512, the convex coupling gear 512' has an involute spline or square spline in the internal circumference, instead of the internal gears 512*a*. For example, as shown in FIG. 12, the coupling gear 512' of this modification is composed of three coupling members 612*x*, 612*y* and 612*z* having an involute spline 612*a* in the internal circumference. In this case, the sliding unit 511 to be fit in the coupling members 612*x*, 612*y* and 612*z* need to have an involute spline corresponding to the involute spline 612*a* in the outer circumference.

The coupling members 612$x$, 612$y$ and 612$z$ can be obtained by machining the shape of the virtual non-divided coupling gear 612, as shown in FIG. 11. The virtual coupling gear 612 mentioned here is not actually manufactured and used, but referred to for the explanation convenience.

The virtual coupling gear 612 has a bevel gear 612$j$ of the quantity of an integer multiple of the number of dividing the gear (hereinafter called a dividing number), and internal gears 612$k$ of the quantity of an integer multiple of the dividing number. In other words, the quantity of dividing the virtual non-divided convex coupling gear 612 as shown in FIG. 11 is a common divisor of the numbers of teeth of the bevel gear 612$j$ and internal gears 612$k$.

The coupling gear 512' of this modification is divided into three parts, and the virtual convex coupling gear 612 before dividing has 36 bevel gears 612$j$ and 15 internal gears 612$k$, for example. By setting the numbers of teeth of the bevel gear 612$j$ and internal gears 612$k$ to an integer multiple of the dividing number, the convex coupling gear 512' can be composed of the same shape coupling members 612$x$, 612$y$ and 612$z$. This permits use of a common mold for manufacturing the coupling members 612$x$, 612$y$ and 612$z$, and decreases the manufacturing cost.

Further, the bevel gear 612$j$ and internal gears 612$k$ of the coupling members 612$x$, 612$y$ and 612$z$ can be retained in the complete form. Namely, the teeth formed in the involute spline 612$a$ inside the coupling members 612$x$, 612$y$ and 612$z$, and virtual tapered surface 612$b$ are divided at the groove between the teeth without missing in the halfway of the teeth.

In other words, in the virtual convex coupling gear 612 in FIG. 11, one tooth of the bevel gear 612$j$ and internal gears 612$k$ are removed at the divided portion as indicated by the broken line in FIG. 12, and the complete form is retained without missing a tooth at the divided end portion.

In this case, as shown in FIG. 12, the number of teeth of the bevel gear 612$j$ and internal gears 612$k$ are identical to the dividing number, and the intersection of the virtual line K passing through the divided position coincides with the center point of the coupling members 612$x$, 612$y$ and 612$z$ (i.e., the center point P of the non-divided virtual convex coupling gear 612).

As shown in FIG. 13, the following relationship is established between the tooth bottom size Q1 of one bevel gear 612$j$ and the tooth bottom size Q2 of one internal gears 612$k$. Assuming that the tooth bottom sizes of two internal gears 612$k$ are Q3 (Q2×2), Q3>Q1>Q2 is established. As shown in FIG. 13, the tooth bottom size is the arc length connecting the concave bottoms of adjacent teeth in a virtual circle around the central point P of the coupling members 612$x$, 612$y$ and 612$z$. The tooth bottom size is established when replaced by a circle pitch (refer to JIS (Japanese Industrial Standard) B1603). It is also established that circle pitch of two internal gears 612$k$>circle pitch of one bevel gear 612$j$>circle pitch of one internal gear 612$k$.

Therefore, the coupling members 612$x$, 612$y$ and 612$z$ can have a perfect gear form in the involute spline 612$a$ and tapered part 612$b$, as shown in FIG. 12. The stress applied to the bevel gear 612$j$ and internal gears 612$k$ can be evenly dispersed, and the strength of the coupling members 612$x$, 612$y$ and 612$z$ can be ensured.

Figure 14:
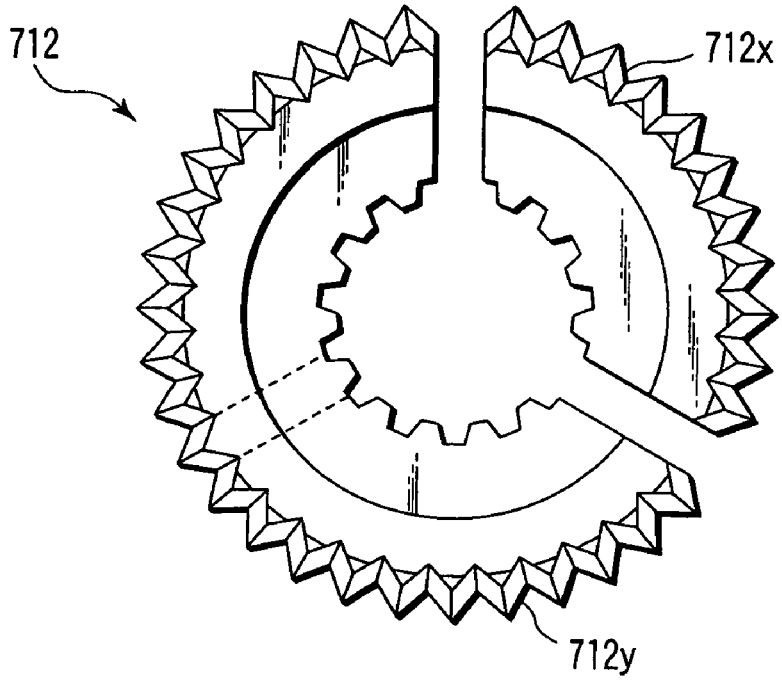
FIG. 14 is a schematic diagram of a convex coupling gear according to a second modification, viewed from the axial direction.

FIG. 14 shows a second modification of the convex gear 512 according to this embodiment. In this coupling gear 712, two coupling members 612$x$ and 612$y$ out of three coupling members 612$x$, 612$y$ and 612$z$ of the first modification coupling gear 512' are not divided, but combined in one body. Namely, this convex coupling gear 712 has a coupling member 712$x$ combining two coupling members 612$x$ and 612$y$, and a coupling member 712$y$.

By forming some coupling members to be divided as one body as described above, the number of parts is decreased, the manufacturing process is simplified, and the manufacturing cost is decreased.

Figure 15:
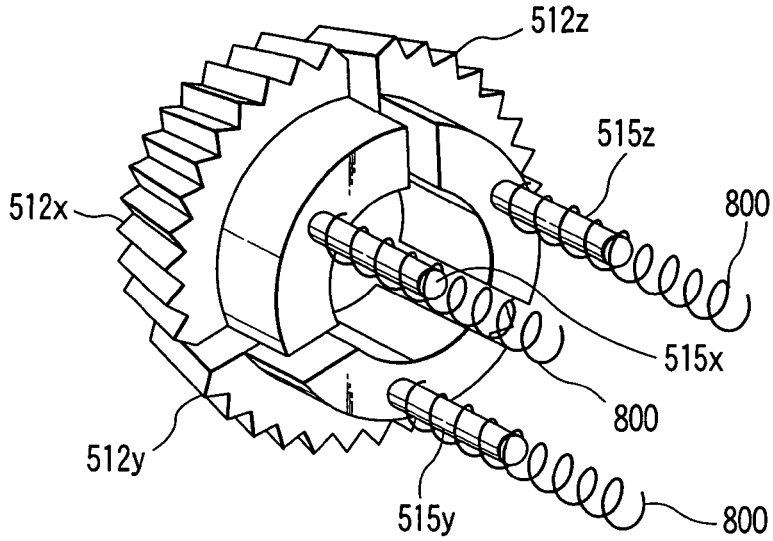
FIG. 15 is a schematic perspective view showing a structure having compression springs to energize independently each coupling member.

Further, in the above-mentioned embodiment, one compression spring 52 shown in FIG. 4 is used as an energizing member to press the convex coupling gear 512 to the concave coupling gear 201. The number of compressing spring is not limited to one. For example, as shown in FIG. 15, three compression springs 800 may be provided to press independently the coupling members 512$x$, 512$y$ and 512$z$. In this case, at the proximal ends of the pressing direction of the coupling members 512$x$, 512$y$ and 512$z$, projected bar-shaped guide members 515$x$, 515$y$ and 515$z$ are provided.

The coupling members 512$x$, 512$y$ and 512$z$ used in this embodiment have a module 0.5, transition coefficient 0.4 and pressure angle 20°, and number of teeth 15 (refer to JIS (Japanese Industrial Standard) B1603).

Figure 16:
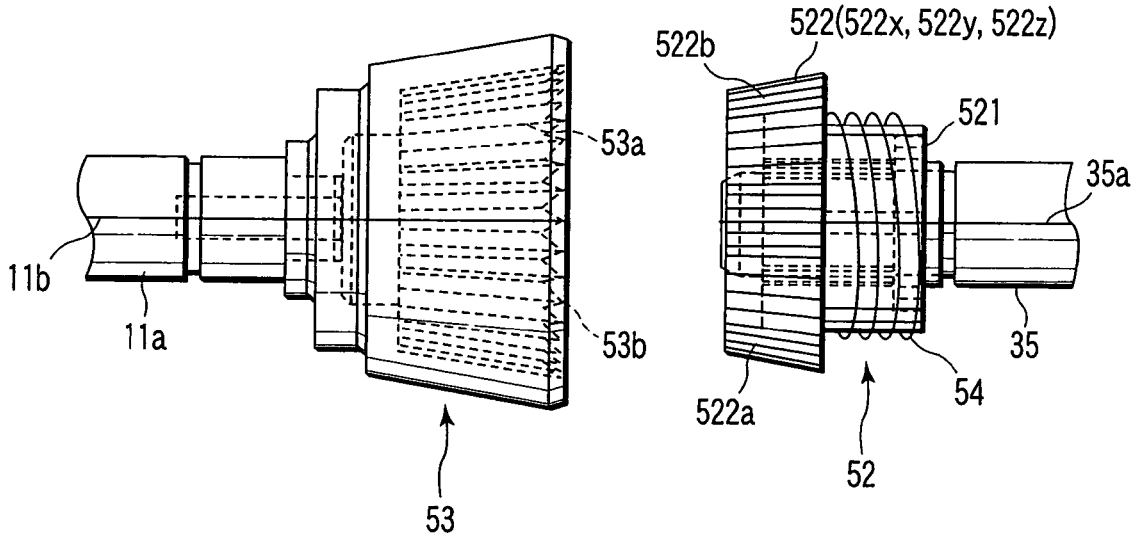
FIG. 16 is a partially magnified external view of an essential part of the drive connection mechanism according to an embodiment of the invention, for explaining an embodiment applied to a connection part for connecting a conveying belt drive roller and a drive shaft.

Explanation will now be given on an embodiment using the drive connection mechanism of the invention in another part of MFP 1. An explanation will be given on an embodiment using the drive connection mechanism in a connection part of the drive roller 11 of the conveying belt 10 with reference to FIG. 3 and FIG. 16. FIG. 16 is a partially magnified view of a connection part for connecting the belt driving shaft 35 and drive roller 11.

As shown in FIG. 3 and FIG. 16, the belt driving shaft 35 is provided with a convex connection member 52 having substantially the same structure as the convex connection member 51. At one end of a rotation shaft 11$a$ of the drive roller 11, a concave connection member 53 to be connected with the convex connection member 52 is provided.

The belt driving shaft 35 is securely provided with sliding unit 521 as in the above described embodiment. A convex coupling gear 522 is slidably fit to the sliding unit 521. The convex coupling gear 522 is composed of coupling members 522$x$, 522$y$ and 522$z$ (three in this embodiment). Each of the coupling members 522$x$, 522$y$ and 522$z$ has a virtual tapered surface 522$a$ on the outside. The tapered surface 522$a$ is provided with bevel gear 522$b$ with equal internals.

A compression spring 54 is fit to the belt driving shaft 35 as an energizing member to press the coupling members 522$x$, 522$y$ and 522$z$ toward the concave connection member 54. Though not shown in the drawing, the coupling members 522$x$, 522$y$ and 522$z$ are configured not to come off the sliding unit 35 even if pressed by the compression spring 54.

The rotation shaft 11$a$ of the drive roller 11 is provided with the concave connection member (concave coupling gear) 53. The concave coupling gear 53 has a tapered surface 53$a$ in the internal circumference, opposite to the tapered surface 522$a$ of the convex coupling gear 522. On the tapered surface 53$a$, bevel gear 53$b$ are provided to engage with the bevel gear 522$b$ formed on the tapered surface 522$a$ of the convex coupling gear 522. Namely, the coupling members 522$x$, 522$y$ and 522$z$ are stuck to the concave coupling gear 53, in the state that the bevel gear 522$b$ and bevel gear 53$b$ are engaged.

By sticking the tapered surface 522$a$ of the convex coupling gear 522 to the tapered surface 53$a$ of the concave coupling gear 53 and fitting the convex coupling gear 522 to the concave coupling gear 53, the shaft center 11$b$ of rotation shaft 11$a$ of the drive roller 11 is automatically aligned with the shaft center 35$a$ of the belt driving shaft 35. Namely, as in the above described embodiment, the centers of the belt driving shaft 35 and drive roller 11 are automatically aligned by adopting the drive connection mechanism.

By pressing the convex coupling gear 522 into the concave coupling gear 53 by the compression spring 54, repulsion toward inside is acted on the coupling members 522*a*, 522*y* and 522*z*. Namely, the coupling members 522*a*, 522*y* and 522*z* are pressed to the center of the belt driving shaft 35.

Then, the bevel gear 522*b* of the convex coupling gear 522 are securely engaged with the bevel gear 53*b* of the concave coupling gear 53 provided in the drive roller 11, the coupling members 522*a*, 522*y* and 522*z* are pressed to the center of the belt driving shaft 35 by the repulsion between the tapered surfaces 522*a* and 53*a*, and the clearance between the coupling members 522*a*, 522*y* and 522*z* and the sliding unit 521 is filled.

Therefore, the centers of the drive roller 11 and belt driving shaft 35 are automatically aligned. Further, by adopting the drive connection mechanism of this embodiment, the driving force from the belt driving shaft 35 is stably and securely transmitted to the drive roller 11 through the convex connection member 54 and concave coupling gear 53, a vibration generated in the drive roller 11 during the rotation of the drive roller is decreased, and a jitter does not occur in a copy image.

As described above, a backlash is eliminated not only from the photoconductive drum 2, but also from the connection part in the drive roller 11, a color matching accuracy is increased, and a jitter and color shift caused by deviation of the drive roller 11 are prevented in a toner transfer image that is overlaid on the conveying belt 10.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

For example, in the example described hereinbefore, the invention is applied to a part for connecting a photoconductive drum and drive shaft, and a part for connecting a drive roller of a conveying belt to a drive shaft. The invention may be applied to any other drive transmission systems.

In a color copier having photoconductive drums for each color (cyan, magenta, yellow and black), the drive connection mechanism of the described embodiment can be used for the photoconductive drum for each color.

The drive connection mechanism of the invention may be used for a drive roller, which transmits power to a conveying belt to convey a transfer medium (paper) to transfer a developer image from a photoconductive drum.

Further, the drive connection mechanism may be used for a drive roller of a belt type transfer unit.

In any case, by using the drive connection mechanism according to the embodiment of the invention for a drive connection mechanism in a developer image transfer process, a jitter and color shift in a copy image can be decreased, and a good image can be formed.

What is claimed is:

1. A drive connection mechanism comprising:

a sliding unit which is provided at the proximal end of a drive shaft extending through a driven unit with the distal end held rotatably, and has splines extended in an axial direction and formed parallel to each other with equal intervals in the outer circumference;

a convex coupling gear which is provided with internal gears to engage with the splines of the sliding part, arranged rotatably together with the drive shaft through the internal gears and slidably in the axial direction of the drive shaft, provided with a first tapered surface inclined in the axial direction to converge toward the distal end on an outer circumference remote from the drive shaft, the first tapered surface having a first bevel gear, and divided into several parts in the circumferential direction;

an energizing member which energizes the convex coupling gear divided into several parts in the axial direction toward the driven unit; and a concave coupling gear which is provided in the driven unit, and has a concave part having a second tapered surface opposite to the first tapered surface of each of the convex coupling gear divided into several parts, and a second bevel gear to engage with the first bevel gear on the second tapered surface.

2. The drive connection mechanism according to claim 1, wherein adjacent opposite end portions of the convex coupling gear divided into several parts are provided with a projection.

3. The drive connection mechanism according to claim 1, further comprising an e-ring which is fit in the drive shaft in the vicinity of the sliding unit to control movement of the convex coupling gear in an axial direction while contacting the end portion of the convex coupling gear in the axial direction, wherein a staged part with an enlarged internal diameter not to interfere with the splines is formed at the end portion of the convex coupling gear opposite to the e-ring.

4. An image forming apparatus comprising:

a image holding unit;

a drive unit for rotating the image holding unit;

an image forming means for forming an image in the periphery of the image holding unit rotated by the drive unit;

a transfer means for transferring the image formed on the periphery of the image holding unit by the image forming means to a transfer medium; and a drive connection mechanism which coaxially connects the drive shaft to transfer the driving force of the drive unit to the image holding unit, wherein the drive connection mechanism has:

splines which are extended in an axial direction along the periphery of the drive shaft and formed parallel to each other with equal intervals;

a convex coupling gear which is provided with internal gears to engage with the splines, arranged rotatably together with the drive shaft through the internal gears and slidably in the axial direction of the drive shaft, provided with a first tapered surface inclined in the axial direction to converge toward the image holding unit on an outer circumference remote from the drive shaft, the first tapered surface having a first bevel gear, and divided into several parts in the circumferential direction;

an energizing member which energizes the convex coupling gear divided into several parts in the axial direction toward the image holding unit; and a concave coupling gear which is provided in the image holding unit, and has a concave part having a second tapered surface opposite to the first tapered surface of each of the convex coupling gear divided into several parts, and a second bevel gear to engage with the first bevel gear on the second tapered surface; and the first bevel gear of the convex coupling gear is stuck without a clearance to the second bevel gear of the concave coupling gear, the drive shaft is connected to the image holding unit, and the splines of the drive shaft are stuck without a clearance to the internal gears of the convex coupling gear, and the centers of the drive shaft and image holding unit are automatically aligned, in the state that the convex coupling gear is pressed to the concave coupling gear by the energizing force of the energizing member, and the drive shaft is connected to the image holding unit.

5. The image forming apparatus according to claim 4, wherein the forms of the first bevel gear and second bevel gear are identical.

6. The image forming apparatus according to claim 4, wherein the forms of the internal gears and splines are identical.

7. The image forming apparatus according to claim 4, wherein the number of the splines is the number of dividing the convex coupling gear plus the number obtained by multiplying the number of dividing by the number of teeth of the internal gears of each convex coupling gear.

8. The image forming apparatus according to claim 4, wherein the number of teeth of the second bevel gear is the number of dividing the convex coupling gear plus the number obtained by multiplying the number of dividing by the number of teeth of the first bevel gear of each convex coupling gear.

9. The image forming apparatus according to claim 4, wherein the convex coupling gear divided into several parts are formed to have the same shape.

10. The image forming apparatus according to claim 4, wherein adjacent opposite end portions of the convex coupling gear divided into several parts are provided with a projection for controlling movement of each convex coupling gear in a circumferential direction.

11. The image forming apparatus according to claim 4, further comprising an e-ring which is fit in the drive shaft to control movement of the convex coupling gear in an axial direction while contacting the end portion of the convex coupling gear in the axial direction, wherein a staged part with an enlarged internal diameter not to interfere with the splines is formed at the end portion of the convex coupling gear opposite to the e-ring.

12. The image forming apparatus according to claim 4, wherein the transfer means has an intermediate transfer unit which transfers an image formed on the periphery of the image holding unit once on the periphery and transfers the image to a transfer medium, a drive unit which rotates the intermediate transfer unit, and a drive connection mechanism which coaxially connects a drive shaft of the drive unit to a rotary unit to rotate the intermediate transfer unit, and the drive connection mechanism has:

splines which are extended in an axial direction along the periphery of the drive shaft and formed parallel to each other with equal intervals;

a convex coupling gear which is provided with internal gears to engage with the splines, arranged rotatably together with the drive shaft through the internal gears and slidably in the axial direction of the drive shaft, provided with a first tapered surface inclined in the axial direction to converge toward the rotary unit on an outer circumference remote from the drive shaft, the first tapered surface having a first bevel gear, and is divided into several parts in the circumferential direction;

an energizing member which energizes the convex coupling gear divided into several parts in the axial direction toward the rotary unit; and a concave coupling gear which is provided in the rotary unit, and has a concave part having a second tapered surface opposite to the first tapered surface of each of the convex coupling gear divided into several parts, and a second bevel gear to engage with the first bevel gear on the second tapered surface; and the first bevel gear of the convex coupling gear is stuck without a clearance to the second bevel gear of the concave coupling gear, the splines of the drive shaft are stuck without a clearance to the internal gears of the convex coupling gear, and the centers of the drive shaft and rotary unit are automatically aligned, in the state that the convex coupling gear is pressed to the concave coupling gear by the force of the energizing member, and the drive shaft is connected to the rotary unit.

* * * * *